US006175332B1

(12) United States Patent
Fedors

(10) Patent No.: US 6,175,332 B1
(45) Date of Patent: Jan. 16, 2001

(54) DIFFRACTIVE BEAM FORMING AND SCANNING ANTENNA ARRAY

(75) Inventor: Richard G. Fedors, Rome, NY (US)

(73) Assignee: The United States of America as represented by the Secretary of the Air Force, Washington, DC (US)

( * ) Notice: Under 35 U.S.C. 154(b), the term of this patent shall be extended for 0 days.

(21) Appl. No.: 09/264,307

(22) Filed: Mar. 8, 1999

Related U.S. Application Data

(63) Continuation-in-part of application No. 08/931,197, filed on Sep. 16, 1997, now abandoned.

(51) Int. Cl.[7] ..... H01Q 1/38
(52) U.S. Cl. ..... 343/700 MS; 343/846
(58) Field of Search ..... 343/700 MS, 795, 343/846; H01Q 1/38

(56) References Cited

U.S. PATENT DOCUMENTS 4,367,474 * 1/1983 Schaubert et al. ..... 343/700 MS
4,379,296 * 4/1983 Farrar et al. ..... 343/700 MS
4,751,513 * 6/1988 Daryoush et al. ..... 343/700 MS
5,777,581 * 7/1998 Lilly et al. ..... 343/700 MS
5,872,542 * 2/1999 Simons et al. ..... 343/700 MS

* cited by examiner

*Primary Examiner*—Hoanganh Le
(74) *Attorney, Agent, or Firm*—Harold L. Burstyn; Luis Ortiz

(57) ABSTRACT

Variable locations on a suitably coated light reactive semiconductor sheet can be illuminated by a pattern of diffracted light to form discrete conductive pathways between antenna radiating elements and an antenna groundplane. Varying the diffracted light pattern temporally and/or spatially changes the conductive pathways and the antenna's beam pattern. Similar variations modify the characteristics of an antenna's radiating element or reflective groundplane, thereby providing frequency control or limited directional control of the beam pattern. Methods for controlling the diffracted light permit an antenna beam pattern to form, redirect, and scan rapidly.

14 Claims, 5 Drawing Sheets

Zero GP

λ GP

2λ GP

DIFFRACTIVE BEAM FORMING AND SCANNING ANTENNA ARRAY

This application is a continuation-in-part of application Ser. No. 08/931,197 filed Sep. 16, 1997 abandoned.

Statement of Government Interest

The invention described herein may be manufactured and used by or for the Government for governmental purposes without the payment of any royalty thereon.

BACKGROUND OF THE INVENTION

The present invention relates to controlling the phase and beam pattern of individual elements in antenna arrays, and, in particular, relates to controlling the phase and beam pattern of the individual elements by means of diffracted light energy.

Radar and radio beams need to be directed, both to find targets and to transfer information effectively. In military environments, directing and shaping the electromagnetic beam help shield friendly signals from detection and reduce the impact of hostile jamming. In wireless communications, transmission quality can be affected by beam pattern. Beam pattern control therefore allows radar and radio equipment to operate more efficiently, thereby saving weight and power.

An antenna in increasing use is the microstrip, which consists of metal foil patterns on a dielectric substrate. Microstrip antennas are efficient. They have a low profile, permit a wide variety of antenna types, and are relatively easy to manufacture. Conformal arrays (that is, arrays shaped to an object) of microstrip antenna elements transmit microwaves in many military systems. In one application, an omnidirectional microstrip antenna wraps a small cylindrical missile body section (Richard C. Johnson editor, *Antenna Engineering Handbook,* 3 ed. (New York, McGraw-Hill Inc., 1993), 7-1-7-30). Multiple-element antennas, phased-array microstrip antennas that incorporate input phase shifters, have also been developed to shape beam patterns and provide electronic beam scanning.

These antenna arrays operate on the basis of wave interference among output signals from each element (*Reference Data for Radio Engineers,* 5 ed. (Indianapolis Ind., Howard W. Sams Co., October 1968), 20–25). By controlling the characteristics of the electromagnetic wave, such as phase and amplitude, emitted by individual elements, the overall beam pattern and orientation of the antenna can be modified to meet specific needs. Adjusting the shapes and location of beam lobes, for example, can effectively "null out" a jammer trying to disrupt radar target detection or radio communications. Controlling the individual elements electronically also allows the main beam of the antenna to scan a wide area without physically rotating. Electronic control of the antenna structure provides faster operation and greater reliability than mechanical scanning or rotation. However, controlling individual elements electronically requires each antenna element to have an electronic phase shifter. These phase shifters substantially increase the weight of and power required by the system, and thus they reduce its reliability.

Optical time-delay networks can replace phase shifters. Optical taps convert signal phase differences to time delays, thereby moving the antenna beam pattern to null out multipath jamming interference (M. E. Turbyfill and J. M. Lutsko, *Anti-Jamming Optical Beam Nuller,* In-House Report RL-TR-96-65 (Rome Laboratory, May 1996)). Optical control promises higher operating speed, and it reduces the tendency of the beam to wander as the frequency changes (so-called radar beam 'squint'). However, optical control requires both considerable computation and a complex electro-optical structure. Such a structure is costly to produce and operate, and it is sensitive to vibration.

Apparatus for controlling the phase and polarization of individual antenna elements was disclosed in U.S. Pat. No. 4,053,895 to Malagisi (1977), the disclosure of which is incorporated herein by reference. Malagisi teaches providing switchable shorting circuits between a common ground plane and the disc antenna elements. In an early embodiment of Malagisi's teaching, metal bolts were raised or lowered to change the circuit. In a later embodiment, the forward or reverse bias of pairs of diodes was controlled to implement open- and short-circuit combinations for each antenna element in the array. This concept was extended in U.S. Pat. No. 4,367,474 to Schaubert et al. (1983) to include computer control of the switching diodes. U.S. Pat. No. 4,751,513 to Daryoush et al. (1988) added discrete photo-diodes that perform the switching action with energy from light. All of the prior art structures rely on fixed componentry and are therefore limited in their ability to provide the flexibility required for modem wireless communication and microwave sensor systems.

Thus there exists a need for a continuously reconfigurable apparatus to control the phase, polarization, and frequency of individual antenna elements that is simple, inexpensive, easy to implement, and substantially insensitive to vibration.

SUMMARY OF THE INVENTION

The present invention is a whole new class of optically controlled phased-array antennas that results from combining light-induced conductivity with reconfigurable antenna elements, controlling light patterns in a novel way, and applying the combination to suitable antenna structures. The simplicity and flexibility of this structure brings the advantages of phased array, multi-frequency antennas to low-cost sensing and communication systems.

It has been known for almost a century that light generates charge carriers in certain materials, allowing an electric current to flow. With sufficient energy (the threshold depends on a material's energy band structure), light can form conductive pathways. For example, a xenon flash lamp shining through shadow masks can illuminate a semiconductor wafer to form bow-tie antennas that transmit radio frequency (RF) signals (T. N. Ding, P. Sillard, P. T Ho,. "A Simple Reconfigurable Antenna," IEEE/LEOS 1995 Summer Topical Meeting on RF Optoelectronics (Keystone, Col., 7-11 August 1995)).

Therefore one feature of the present invention provides a method for controlling the phase and polarization of individual antenna elements that overcomes the drawbacks of the prior art.

Another feature of the present invention provides an apparatus that controls the phase and polarization of individual antenna elements by means of light.

In the present invention, variable locations on a suitably coated, light reactive semiconductor sheet are illuminated by diffracted light to form conductive pathways between antenna radiating elements and an antenna groundplane, as well as to form entirely new radiators and groundplanes. Varying the diffracted light pattern temporally and/or spatially changes the conductive pathways and the antenna's beam pattern. A similar variation modifies the characteristics of an antenna's reflective groundplane, thereby providing limited directional control of the beam pattern. Several methods for controlling the diffracted light permit an antenna beam pattern to form, change frequency, redirect, and scan rapidly.

The present invention can allow specific locations on a suitably coated semiconductor sheet illuminated by diffracted light pattern to form discrete conductive pathways between antenna radiating elements and an antenna groundplane. Varying the diffracted light pattern temporally and/or spatially changes the conductive pathways and the antenna's beam pattern. Similar variations modify the characteristics of an antenna's radiating element or reflective groundplane, thereby providing frequency control or limited directional control of the beam pattern. Several methods for controlling the diffracted light permit an antenna beam pattern to form, redirect, and scan rapidly.

These and other features and advantages of the present invention will be readily apparent to one skilled in the pertinent art from the following detailed description of a preferred embodiment of the invention and the related drawings, in which like reference numerals designate the same elements.

DESCRIPTION OF THE PREFERRED EMBODIMENT

Figure 1:
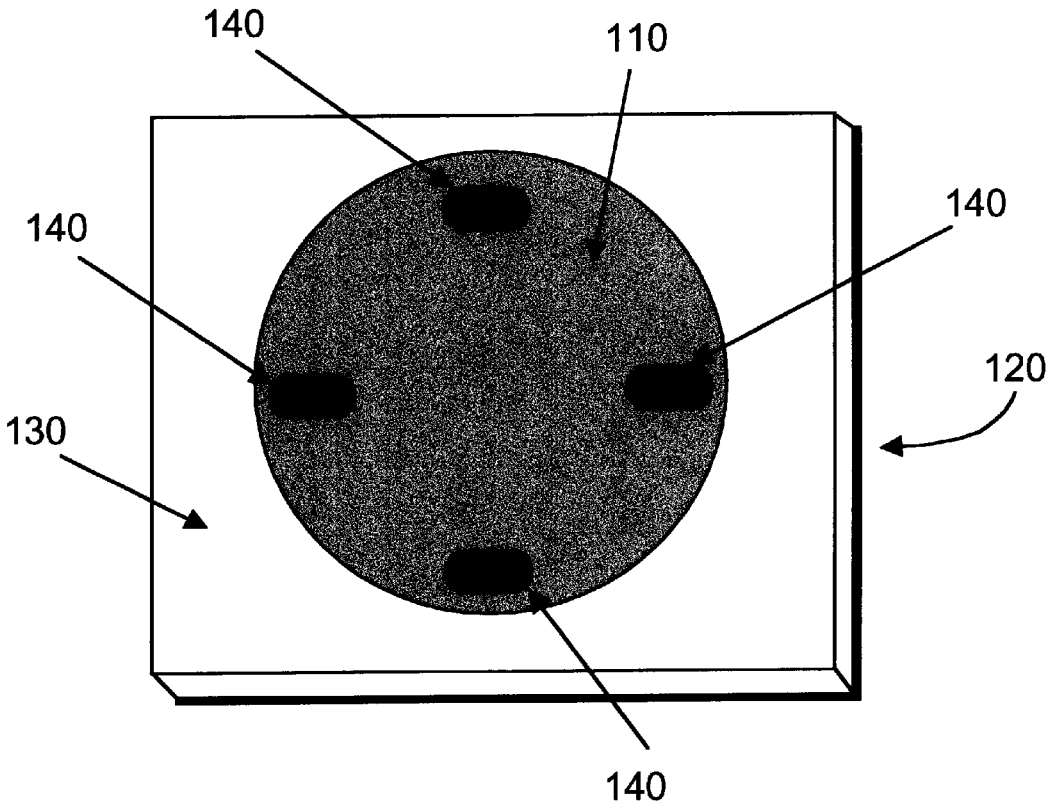
FIG. 1 is a perspective view from the front of a single antenna element in one embodiment of the present invention.

Referring to FIG. 1, one embodiment of the invention provides a metallic radiator 110, sized according to the desired operating wavelength, separated from a conductive groundplane 120 by a semiconductor substrate 130 of silicon or similar material. Groundplane member 120 may be formed of a semiconductor, or other conductive material such as indium-tin-oxide (ITO), that is substantially transparent. Groundplane member 120 would be substantially transparent to allow light to pass to semiconductor substrate 130. However, in applications not requiring light to pass through groundplane member 120, the groundplane member may be formed from a broader selection of conductive materials.

In operations, continuously variable light-induced conductivity paths 140 (shorting locations) are generated by steady or intermittent light passing through transparent groundplane member 120 to form temporary conductive pathways between metallic radiator 110, which is RF-driven, and groundplane member 120.

Figure 2:
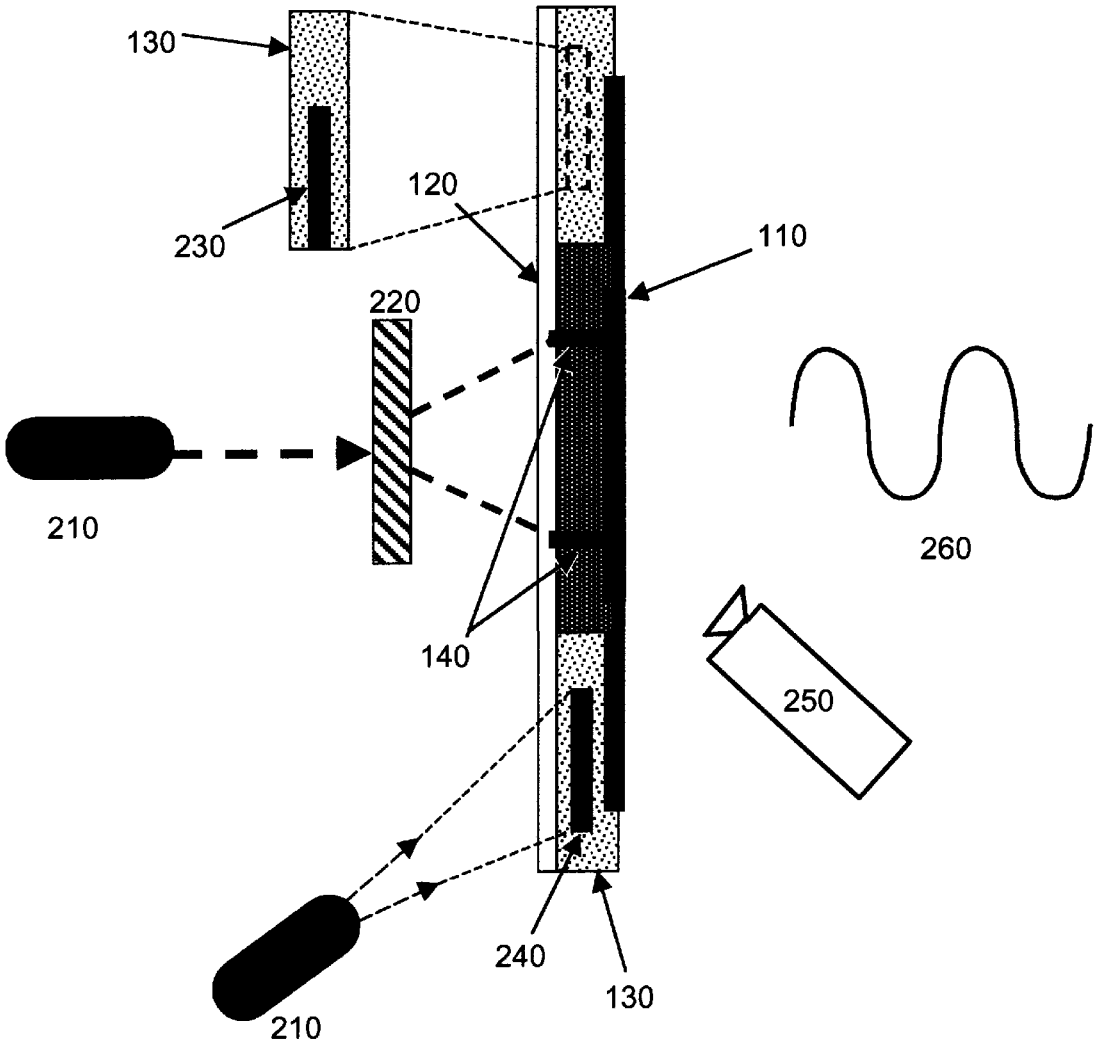
FIG. 2 is a cross-section of the radiating antenna element of FIG. 1.

In one embodiment of the invention illustrated in FIG. 2, a light source and control optic combine to excite specific portions of substrate 130 to form conductive pathways. A coherent light source 210 shines through a diffractive grating 220 to produce a specific intensity pattern on the substrate 130. This variable-intensity pattern passes through transparent groundplane 120 to form corresponding conductivity paths 140 within semiconductor substrate 130 to activate shorting from diffractive grating 220 to groundplane 120. A thin anti-reflection coating on the input side of groundplane 120 ensures efficient coupling of energy from light source 210 into semiconductor substrate 130. Metallic radiator 110, fed by an RF signal source 250, completes the antenna, which radiates an electromagnetic signal 260 into free space.

Conductivity paths 140 at different locations control signal phase to form and scan the RF energy from a single element. For example, if conductivity path 140 to groundplane 120 with a suitable feed is located at the center of a circular radiator, it would force a $TE_{11}$ mode, as taught by Malagisi. Alternate shorting of the vertical axis and horizontal axis paths shown in FIG. 1 would shift the reflected field phases 180 degrees. Increasing the pairs of conductivity paths 140 on the periphery would allow progressively smaller phase changes. One version of a reconfigurable subreflector 230 is illustrated in FIG. 2, whereby a conductive region is induced by light circumscribing smaller transparent ground plane member 120 within semiconductor substrate 130. Any subreflector could function independently of the antenna-ground plane shorting parts and RF feed to provide another dimension to controlling overall antenna characteristics.

Reconfigurable parasitic antenna elements 240 could be formed in semiconductor substrate 130 by edge illumination, as shown in FIG. 2. Illuminated by a second coherent light source 210 on opposite edges of semiconductor substrate 130, parasitic antenna elements 240 of varying sizes could also be scanned from the front edge to the back edge of semiconductor substrate 130 to provide another dimension in RF antenna control, again independent of the basic antenna. It is also possible to form parasitic antenna elements 240 through backside illumination as symmetric bars or arcs to metallic radiator 110.

Figure 3:
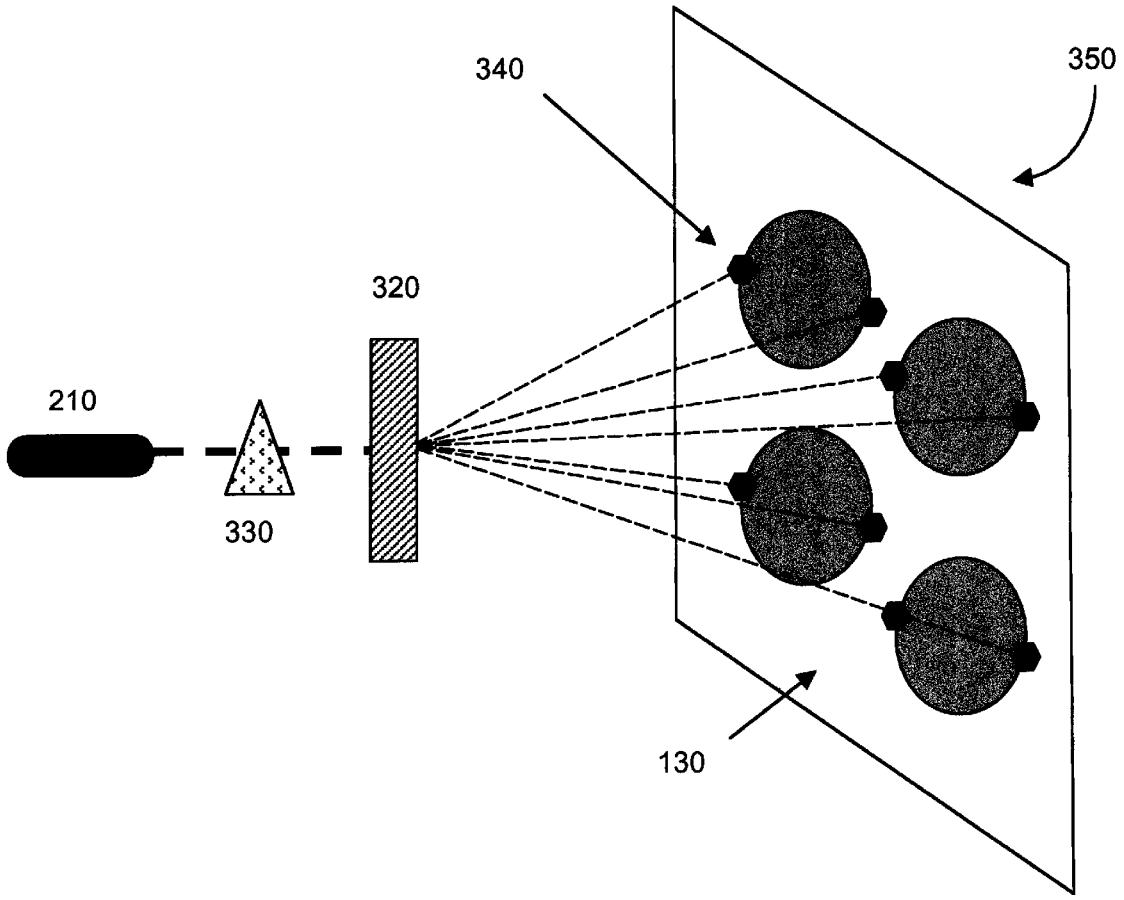
FIG. 3 shows a phased-array, optically controlled antenna of the present invention.

In another embodiment of the invention, a plurality of metallic radiators 110 arranged on a substrate 130 form an antenna array, a simplified version of which is shown in FIG. 3. Illuminating a multi-grating diffractive optic 320 in different regions with an electro-optic beam scanner 330 produces a variety of spot patterns on substrate 130 and near and/or on the metallic radiators. As substrate 130 is light sensitive, it becomes conductive as a reaction to the spot patterns of light, causing variable light-induced switching actions 340 to occur between radiators, and/or radiators and a groundplane member, thereby changing the phase of reflected radio frequency energy across several antenna elements at once. Coordinated control of all surrounding elements in the array forms a variable RF beam pattern in free space that can be directed and scanned. The result is a rapidly scanning, customizable beam pattern antenna. And the principle of reciprocity (see Thereza MacNamara, *Handbook of Antennas for EMC,* (Norwood Mass., Artech House Inc., 1995) pages 6, 133) means that the light-controlled beam pattern allows the antenna to receive as well as transmit radio and microwave energy.

The principal advantage of the apparatus of the present invention comes from replacing a complex electronic phase-shifting network with simple light patterns that vary in intensity. This substitution reduces the electrical power to the antenna array and eliminates interference between the phase control and radio frequency circuits. Controlling the shorting paths between metallic radiator 110 and the back reflector by light beams also provides a continuous phase variation, rather than the limited phases provided by discrete diodes located at fixed locations on the periphery of the antenna elements. This continuous phase variation permits the beam to move in smaller increments, allowing a greater variation in beam steering angles. Smaller increments improve target location and reduce the effects of jamming.

With diffractive optics, in the form of reflective/transmissive gratings or acousto-optic cells, antenna radiating element-to-groundplane shorting patterns become exceptionally flexible. Beam agility is promoted by conducting patterns that move nearly instantaneously. Where antenna beams must be rapidly steered to overcome jamming or minimize signal interception, the structure of the present invention is a great advantage. It can decrease the number of separate antennas needed at communication centers, reduce fuel consumption for fast moving vehicles, and help avoid damage to sensitive antennas on mobile platforms.

The previous embodiment describes a reflective RF feed mode for the diffractively controlled antenna. It is also possible to drive the antenna elements directly with RF energy, making it an active antenna element. In another embodiment, arranging two feeds 90 degrees from each other on a disc element and feeding them from sources 90 degrees out of phase produces a circular polarization, as taught by Malagisi. In other embodiments, other feed arrangements produce linear polarization. In still other embodiments, radial movement of the feeds adjust the antenna element's impedance. As in the earlier description of the edge-shorting locations, diffractively controlled light can change the locations of temporary conductivity for active element feeds, thus modifying the antenna's polarization and characteristic impedance.

Still another embodiment of the present invention is to control directly the physical characteristics of the groundplane located behind the radiating antenna. The groundplane can be switched on or off with light energy to control antenna gain. Light-induced conductivity thus changes the electrical size and shape of the groundplane. Assuming a uniform azimuthal beam pattern for a monopole antenna, changing the groundplane size from zero to infinity (as a function of the wavelength) moves beam peak intensity elevation angle between horizontal and approximately 35 degrees from vertical (Melvin M. Weiner et. al., Monopole Elements On Circular Ground Planes, (Norwood Mass., Artech House Inc., 1987)).

Figure 4A:
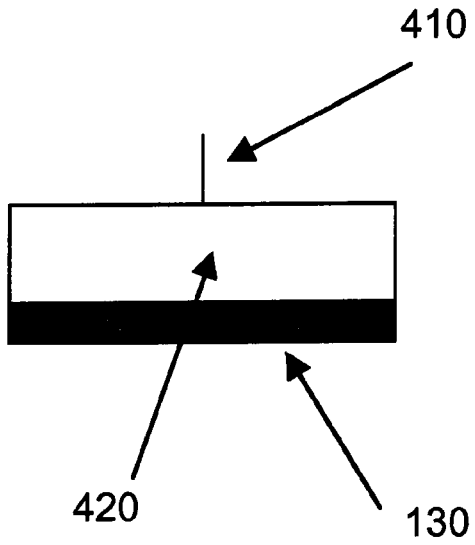
FIG. 4A illustrates a monopole radiating antenna element without illumination.
Figure 4B:
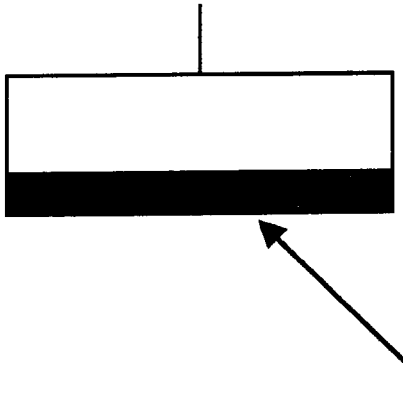
FIGS. 4B and 4C illustrate the variation in the size and geometry of a groundplane element (440) and/or semiconductor substrate (130) resulting from partial illumination of the light sensitive substrate with varying illumination patterns.
Figure 4C:
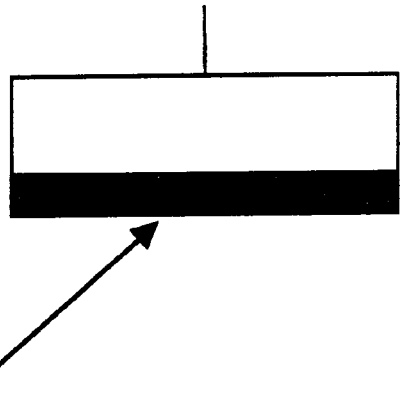
Figure 5A:
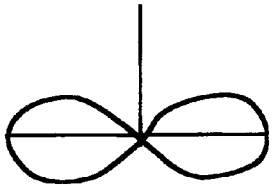
FIGS. 5A, 5B, and 5C show the approximate change in antenna beam pattern for the monopole radiator of FIGS. 4A, 4B, and 4C, respectively, as the underlying conductive ground plane size increases.
Figure 5B:
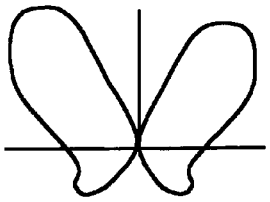
Figure 5C:
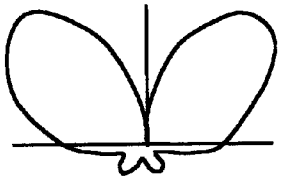

Referring to FIGS. 4A, 4B, and 4C, for a monopole radiating element 410, successive increases in the size of a resizable groundplane 440, by appropriate illumination of semiconductor substrate 130, change the beam pattern, as shown in FIGS. 5A, 5B, and 5C, respectively. In the illustrated embodiment, an insulator 420 may separate monopole-radiating element 410 from semiconductor substrate 130. The size of resizable groundplane 440 can be altered by suitable masks or diffractive optics (antenna RF feed not shown). To conserve system power and minimize the heating effect of optical energy transmitted into the silicon layer, a grid, radial, or dot pattern of light can replace a broad area beam of constant intensity. Projecting such a pattern forms a mesh-like conductivity pattern with openings significantly smaller than the antenna operating wavelength, thereby providing an effective resizable groundplane 440.

A similar arrangement could provide conductive subreflectors or parasitic elements within the semiconductor substrate, analogous to a "stacked" antenna. Such an arrangement would effect additional variation and control of an antenna's reception/transmission characteristics.

New polymers under development can also function as light-induced groundplanes. The efficiency of such groundplanes can vary, thereby controlling RF output (amplitude) and thus minimizing communication intercepts. Together with adjacent elements in an array, such a combination provides a significant degree of beam directivity, beam scanning capability, and radiated power control for future wireless radio communication and radar sensor systems.

The planar structure of the antennas of the present invention lends them to incorporation on a wide variety of platforms or facilities. They can be installed on vehicle roofs or communications van walls. They can be contoured to fit the fuselage on cruise missiles, unmanned aerial vehicles, or aircraft, thereby replacing numerous protruding antennas. Such installations reduce aerodynamic drag and radar cross-section for many military applications. Antennas of the present invention also provide a back-up transmission/reception aperture where primary antennas are retracted for stealth. An array of commercial wireless communication applications also lend themselves to the advantages of the present invention.

The flexibility brought about by variable light-induced conductivity therefore provides continuously reconfigurable RF energy radiators, shorting posts, ground planes, subreflectors, and parasitic elements to meet a plethora of electromagnetic energy transmission and reception applications.

Clearly many modifications and variations of the present invention are possible in light of the above teachings. It should therefore be understood that, within the scope of the inventive concept, the invention might be practiced otherwise than as specifically claimed.

What is claimed is:

1. An reconfigurable antenna element, comprising:

an electrically conductive radiator;

a transparent, electrically conductive ground plane member in juxtaposition with said radiator; and a light sensitive semiconductor medium separating said radiator and said ground plane member, said medium being reactive throughout its entire volume to form a plurality of conductive pathways between said radiator and said ground plane member based on random light patterns generated by a light source and shown on said medium.

2. The reconfigurable antenna element of claim 1, wherein said ground plane member is a semiconductor.

3. The antenna element of claim 2, wherein said radiator is a microstrip.

4. The antenna element of claim 1, wherein said radiator is a microstrip.

5. An antenna array, which comprises:

a plurality of electrically conductive radiators;

a transparent, electrically conductive ground plane member in juxtaposition with said plurality of electrically conductive radiators;

a light-sensitive semiconductor medium separating said plurality of electrically conductive radiators and said ground plane member, said medium being reactive throughout its entire volume to form a plurality of conductive pathways between said electrically conductive radiators and said ground plane member based on random light patterns generated by a light source and shown on said medium;

a light source effective for providing random patterns of light to said light-sensitive semiconductor medium; and means for coupling RF energy to each of said plurality of electrically conductive radiators.

6. The antenna array of claim 5, wherein each of said plurality of electrically conductive radiators is a microstrip.

7. The antenna array of claim 5, wherein said ground plane member is a semiconductor.

8. The antenna array of claim 7, wherein each of said plurality of electrically conductive radiators is a microstrip.

9. A method of controlling the phase and beam transmission and reception of an antenna, which comprises the steps of:

forming an antenna by coating a light-reactive semiconductor material with conductive material to form a pattern of individual radiating elements;

illuminating said light-reactive semiconductor material with a pattern of light to form conductive pathways, based on said pattern of light, at locations between each of said radiating elements and a transparent conductive ground plane; and varying said pattern of light to change said pathways, thereby varying phase and beam transmission and reception of said antenna.

10. The method of claim 9, wherein said step of varying further includes changing feed locations, thereby changing polarization of said beam transmission.

11. The method of claim 9, wherein said step of varying further includes changing at least one of the size and the conductivity of said ground plane.

12. The method of claim 9, wherein said step of illuminating includes generating at least one variable sub-reflector within said antenna.

13. The method of claim 9, wherein said step of illuminating includes generating at least one parasitic element within said antenna.

14. The method of claim 9, wherein said step of illuminating said pattern of light further comprises controlling a diffracted light on said light-reactive semiconductor material to form variable selective discrete conductive pathways between said radiating elements and said ground plane.

* * * * *